US006109377A

United States Patent [19]

Massa et al.

[11] Patent Number: 6,109,377

[45] Date of Patent: Aug. 29, 2000

[54] ROTATABLE CUTTING BIT ASSEMBLY WITH CUTTING INSERTS

[75] Inventors: Ted R. Massa, Latrobe; David R. Siddle, Greensburg, both of Pa.

[73] Assignee: Kennametal Inc., Latrobe, Pa.

[21] Appl. No.: 08/893,059

[22] Filed: Jul. 15, 1997

[51] Int. Cl.[7] ..... E21B 12/38

[52] U.S. Cl. ..... 175/417; 175/420.1; 175/425

[58] Field of Search ..... 175/393, 417, 175/412, 418, 420.1, 421, 425, 426, 427, 432

[56] References Cited

U.S. PATENT DOCUMENTS

| | | | |
|---|---|---|---|
| 882,128 | 3/1908 | Thomas . | |
| 1,318,958 | 10/1919 | Bernay . | |
| 1,582,283 | 4/1926 | Lane | 175/412 X |
| 2,002,388 | 5/1935 | Bannister . | |
| 2,575,239 | 11/1951 | Stephens | 255/61 |
| 2,649,284 | 8/1953 | Letts | 175/412 |
| 2,902,260 | 9/1959 | Tilden . | |
| 3,140,749 | 7/1964 | Dionisotti | 175/410 |
| 3,163,246 | 12/1964 | Vagins et al. | 175/410 |
| 3,362,489 | 1/1968 | Miller . | |
| 3,434,553 | 3/1969 | Weller | 175/410 |
| 3,434,554 | 3/1969 | Bower et al. | 175/410 |
| 3,765,496 | 10/1973 | Flores et al. | 175/383 |
| 3,878,905 | 4/1975 | Schaumann | 175/383 |
| 4,026,372 | 5/1977 | Hampson | 175/410 |
| 4,313,506 | 2/1982 | O'Connell | 175/418 X |
| 4,340,327 | 7/1982 | Martins | 408/59 |
| 4,355,932 | 10/1982 | Koppelmann et al. | 408/188 |
| 4,433,739 | 2/1984 | Sarin | 175/410 |
| 4,492,278 | 1/1985 | Leighton | 175/410 |
| 4,527,931 | 7/1985 | Sarin | 407/113 |
| 4,533,004 | 8/1985 | Ecer | 175/329 |
| 4,603,751 | 8/1986 | Erickson | 175/410 |
| 4,711,312 | 12/1987 | Leibee et al. | 175/393 |
| 4,819,748 | 4/1989 | Truscott | 175/393 X |
| 4,844,669 | 7/1989 | Tsujimura et al. | 408/188 |
| 5,137,398 | 8/1992 | Omori et al. | 408/145 |
| 5,172,775 | 12/1992 | Sheirer et al. | 175/420.1 X |
| 5,180,022 | 1/1993 | Brady | 175/430 |
| 5,180,697 | 1/1993 | Claar et al. | 501/96 |
| 5,184,689 | 2/1993 | Sheirer et al. | 175/420.1 |
| 5,220,967 | 6/1993 | Monyak | 175/420.1 |
| 5,269,387 | 12/1993 | Nance | 175/427 X |
| 5,287,937 | 2/1994 | Sollami et al. | 175/427 |
| 5,400,861 | 3/1995 | Sheirer | 175/427 |
| 5,452,628 | 9/1995 | Montgomery, Jr. et al. | 175/393 X |
| 5,458,210 | 10/1995 | Sollami | 175/420.1 |
| 5,679,445 | 10/1997 | Massa et al. | 175/379 X |
| 5,718,541 | 2/1998 | Bryant | 407/118 |

FOREIGN PATENT DOCUMENTS

| | | |
|---|---|---|
| 0154936 | 9/1985 | European Pat. Off. . |
| 0285678 | 10/1988 | European Pat. Off. . |
| 0381793 | 8/1990 | European Pat. Off. . |
| 2423313 | of 1979 | France . |
| 2543212 | of 1984 | France . |
| 4004814 | 8/1991 | Germany . |
| 646045 | 5/1979 | U.S.S.R. . |
| 669636 | 4/1952 | United Kingdom . |
| 2022476 | 12/1979 | United Kingdom . |
| 95/30066 | 11/1995 | WIPO . |

OTHER PUBLICATIONS

International Search Report PCT Patent application PCT/US98/14358.

Partial International Search PCT Pat. App'l PCT/US98/14358 (Oct. 26,1998).

Fairhurst, C., The Design of Rotary Drilling Bits, pp. 271–275.

Brochure entitled Mining Tools by Kopex (date unknown).

Kennametal Mining Products Catalog A96–55(15)H6, Kennametal Inc. Latrobe PA 15650, 36 pages. (1996).

*Primary Examiner*—Frank Tsay
*Attorney, Agent, or Firm*—John J. Prizzi

[57] ABSTRACT

A rotatable cutting bit which comprises an elongate bit body which has a forward end and a rearward end and which defines a peripheral surface. The bit body contains a first seat at the axially forward end thereof. A first cutting insert is mechanically retained in the seat so as to present a clearance cutting edge which radially extends past the peripheral surface of the bit body. The first cutting insert has a leading cutting edge disposed at a lead angle between 50 degrees and 80 degrees.

40 Claims, 7 Drawing Sheets

ROTATABLE CUTTING BIT ASSEMBLY WITH CUTTING INSERTS

BACKGROUND OF THE INVENTION

The expansion of an underground mine (e.g. a coal mine) requires digging a tunnel which initially has an unsupported roof. To stabilize and support the roof a roof bolt must be inserted into the roof to provide support. The operator must first drill holes in the roof through the use of a rotatable cutting bit or roof drill bit. A roof bolt is then inserted into each one of the holes.

A common roof drill bit design uses a cutting insert that has been brazed into a slot at the axially forward end of the roof drill bit body. U.S. Pat. No. 5,400,861 to Sheirer discloses various roof drill bits. U.S. Pat. No. 4,603,751 Erickson also discloses various roof drill bits. Applicants hereby incorporate U.S. Pat. Nos. 4,603,751 and 5,400,861 by reference herein. In addition, the following catalogs published by Kennametal Inc. of Latrobe, Pennsylvania (U.S.A.), which are hereby incorporated by reference herein, disclose roof drill bits: "Kennametal Mining Products", Catalog A96-55(15)H6 (September 1996) [36 pages in length], and "Kennametal Mining Products" Catalog B92-75R(3)M5 (1992) [36 pages in length].

While brazed-on cutting inserts have provided adequate results in the drilling of holes, there have been some drawbacks associated with the utilization of the brazed-on cutting inserts. As a result of brazing, the difference in the coefficients of thermal expansion between the steel roof drill bit body and the cemented carbide (e.g., tungsten carbide-cobalt alloy) cutting insert has caused residual stresses in the cemented carbide cutting insert. These residual stresses have been detrimental to the performance of the roof drill bit since they have lead to premature failure of the cutting insert. This has been especially true in those cases where the earth strata being drilled has resulted in high impact loading on the cutting insert.

The presence of these residual stresses also has required that the grades of cemented carbide used for the cutting insert have had a high transverse rupture strength. This has been a factor which has limited the number of grades which have been suitable candidates for a cutting insert in a rotatable cutting bit such as a roof drill bit.

Some materials (e.g., ceramics, low binder content [3 to 6 weight percent binder] tungsten carbide, binderless tungsten carbide, diamond or refractory [CVD or PVD] coated cemented carbides or ceramics, polycrystalline diamond [PCD] composites, polycrystalline cubic boron nitride [PcBN] composites) may have been suitable materials for use as a cutting insert in a roof drill bit because of their increased wear resistance, but have not been good candidates for use as a cutting insert in a roof drill bit due to brazing difficulties. More specifically, either these materials have been difficult to satisfactorily braze, or when brazed, these materials have experienced unacceptably high residual brazing-induced stresses.

In view of the drawbacks associated with brazing the cutting insert into the seat of a roof drill bit, it would be desirable to provide a roof drill bit wherein the cutting insert would be affixed within the seat of the roof drill bit without using a brazing process. Such a roof drill bit would have less of a chance of premature failure due to the presence of residual stresses. Such a roof drill bit would be able to use a wider range of materials for the cutting insert than has been heretofore available.

There comes a point where the cutting insert in the roof drill bit has reached a condition where the cutting action by the bit is no longer sufficient. At this point one of two processes occurs. One process comprises the regrinding of the cutting insert without removing the cutting insert from the roof drill bit. The other process comprises debrazing the cutting insert so as to be able to remove it from the roof drill bit body, and then brazing a new cutting insert to the roof drill bit body. Each process has certain costs associated therewith which add to the overall cost of the drilling operation.

To reduce these additional costs it would be desirable to provide a roof drilling bit which would not require regrinding to place the cutting insert back in condition for cutting. It would also be desirable to provide a roof drilling bit that does not require debrazing/brazing of the cutting insert to replace a worn cutting insert.

Roof drill bits which have a higher penetration rate for the drilling operation are desirable in that such a drill typically takes less time to drill the required number of holes in the mine roof (i.e., earth strata). The ability of the roof drill bit to use a cutting insert made from a more wear resistant material, such as those identified above, enhances the potential to maintain a higher penetration rate at a given thrust level for a longer time. Thus, it would also be desirable to provide an improved roof drill bit that has a high penetration rate.

SUMMARY

In one form thereof, the invention is a rotatable cutting bit for penetrating an earth formation wherein the bit comprises an elongate bit body having a forward end and a rearward end, a peripheral surface, a central longitudinal axis and a center of rotation. The bit body contains a first seat and a second seat at the axially forward end thereof. The cutting bit further includes a first cutting insert in the first seat so as to present a first clearance cutting edge which radially extends past the peripheral surface of the bit body so as to engage the earth formation. The first cutting insert has a first leading cutting edge that engages the earth formation wherein the first leading cutting edge is disposed at a first lead angle (C) between 50 degrees and 90 degrees. The first lead angle (C) is the included angle between a pair of intersecting lines (E—E and F—F) wherein one line (E—E) is along the first leading cutting edge and another line (F—F) is parallel to the center of rotation of the bit body. The cutting bit also includes a second cutting insert in the second seat so as to present a second clearance cutting edge which radially extends past the peripheral surface of the bit body so as to engage the earth formation. The second cutting insert has a second leading cutting edge that engages the earth formation. The second leading cutting edge is disposed at a second lead angle (C) between 50 degrees and 90 degrees wherein the second lead angle (C) is the included angle between a pair of intersecting lines (E—E and F—F) wherein one line (E—E) is along the second leading cutting edge and another line (F—F) is parallel to the center of rotation of the bit body.

In another form thereof, the invention is a cutting insert for use in a rotatable cutting bit for the penetration of an earth formation wherein the cutting insert is disposed in a seat in the cutting bit with a peripheral surface wherein the leading cutting edge which engages the earth formation is disposed at a lead angle (C) between 50 degrees and 90 degrees. The cutting insert comprises a cutting insert body having a top surface, a bottom surface, a first side surface, and a second side surface. The first side surface intersects the second side surface to form a first edge. The first and second side surfaces join the top surface and the bottom surface. The first edge defines at least in part a clearance cutting edge which extends radially past the peripheral surface of the cutting bit when the cutting insert is in the seat so as to engage the earth formation.

BRIEF DESCRIPTION OF THE DRAWINGS

The following is a brief description of the drawings that form a part of this patent application.

DETAILED DESCRIPTION

Figure 1:
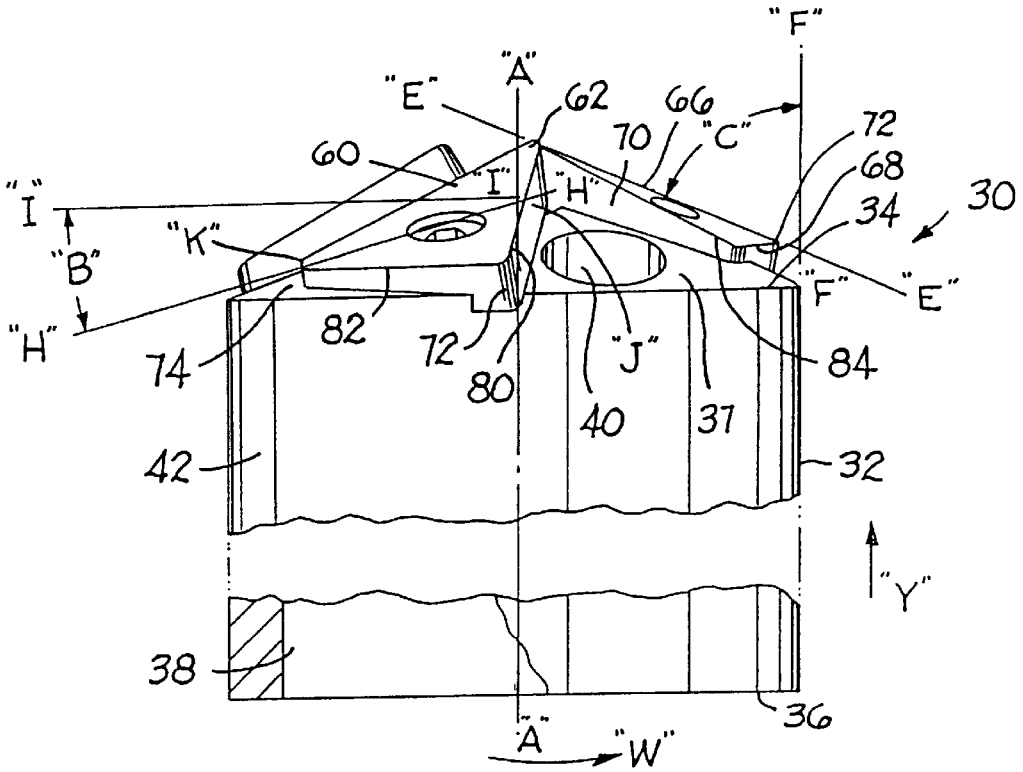
FIG. 1 is a side view of a specific embodiment of a rotatable cutting bit wherein a portion of the wall of the bit body has been cut away so as to reveal the presence of a cavity.

Referring to the drawings, a rotatable cutting bit (or roof drill bit) generally designated as 30 has an elongate bit body 32 with a forward end 34 and a rearward end 36, as well as a central longitudinal axis A—A (see FIG. 1). Bit body 32 has a forward surface 37 which presents a generally frusto-conical shape. The bit body 32 defines a cavity 38 therein. The bit body 32 further contains at the forward end 34 thereof a plurality of unobstructed debris evacuation passages 40 which communicate with the cavity 38 so as to provide communication between the cavity and the forward end of the bit body. Although the specific embodiment illustrates a trio of equi-spaced peripheral debris evacuation passages and one central debris evacuation passage, applicants contemplate that any number of passage(s) in a suitable orientation or a single passage could be appropriate. Applicants also contemplate that the cutting bit body may not include any debris evacuation passages. The bit body 32 is of a generally cylindrical shape so as to present a peripheral (or generally cylindrical) surface 42.

Applicants also contemplate that the present roof bit may be used in a wet drilling operation. In a wet drilling operation, the passages 40 would function to provide a pathway for a flow of fluid (e.g., water) to the forward end of the bit body, i.e., fluid would flow through the passages 40. Applicants also contemplate that for a wet drilling operation, the outside surface of the bit body may contain flats, or some other relief in the surface, so as to provide a passage for the fluid and debris to exit from near the cutting inserts.

Figure 2:
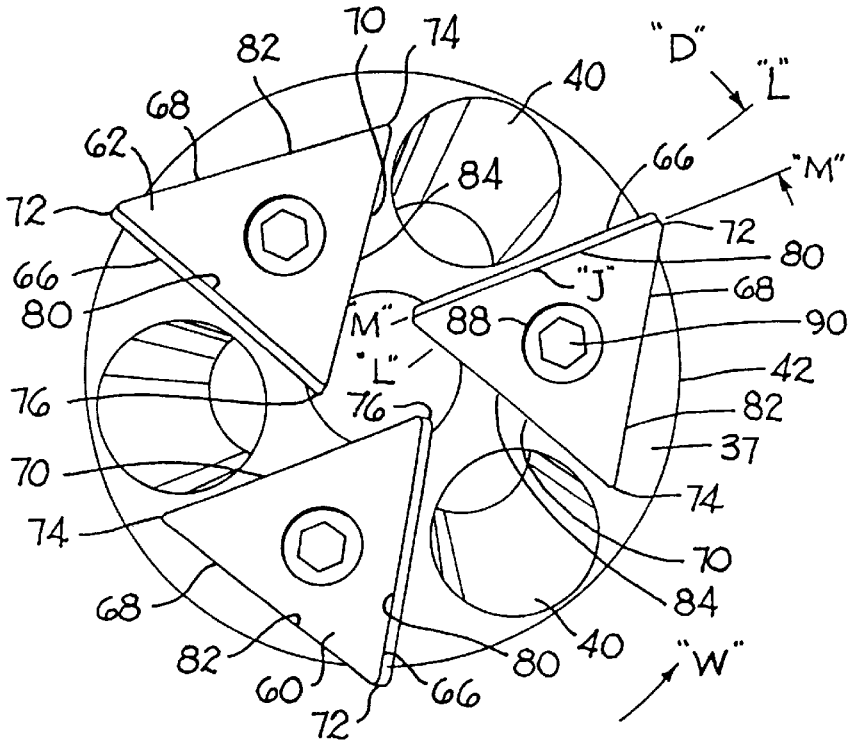
FIG. 2 is a top view of the rotatable cutting bit of FIG. 1.
Figure 3:
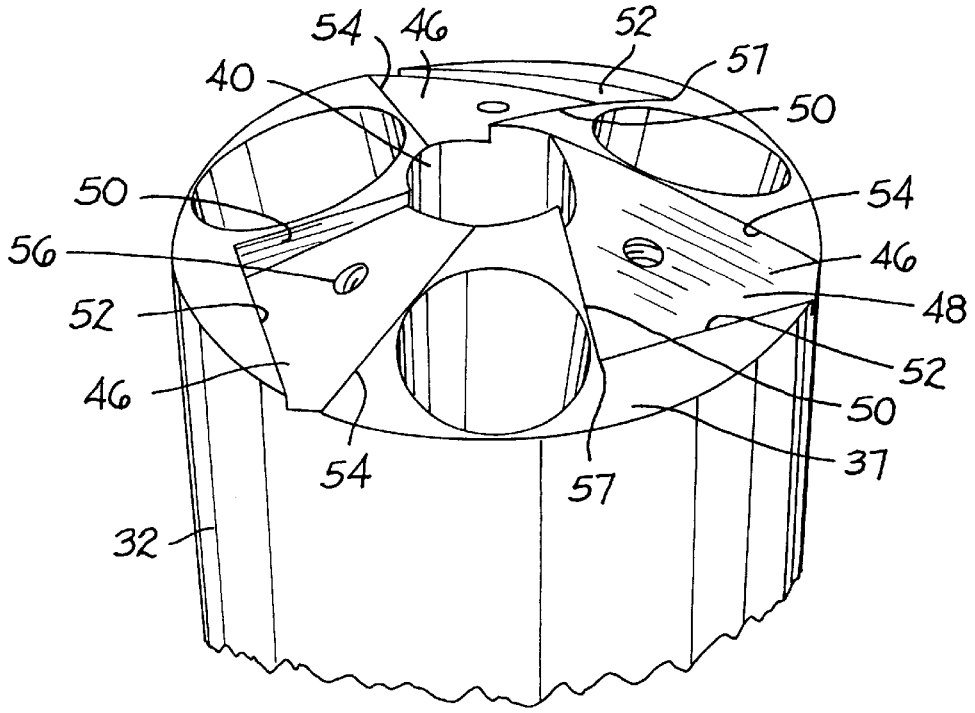
FIG. 3 is an isometric view of the rotatable cutting bit of FIG. 1 without the cutting inserts in their respective seats.

Referring to FIG. 3, the bit body 32 further contains a trio of seats (or pockets) 46, each of which contains a cutting insert 60 of a first specific embodiment. Although the specific embodiment of FIGS. 1 and 2 shows three seats 46 and three cutting inserts 60, there is no intention to limit the invention to the use of three cutting inserts (and seats). Applicants contemplate that the invention would function with two or more cutting inserts (and seats). The dimension of the cutting bit body and the cutting inserts, as well as the particular cutting application, are factors which would influence the number of cutting inserts (and seats) presented by the rotatable cutting bit.

The following description of one seat 46 as illustrated in FIG. 3 will suffice for the description of the other two seats 46 since these three seats are essentially identical. Seat 46 presents a generally triangular shape. Seat 46 has a bottom surface 48. Seat 46 also presents a generally radial side surface 50, a generally chordal side surface 52, and a generally radial edge 54. In the specific embodiment, the radial edge 54 is generally flush with the surface of the bit body 32 at the forward end 34 thereof. However, applicants do not intend to limit the invention to radial edge 54 being flush, but contemplate that radial edge 54 could have depth thereto. The seat 46 is defined by the bottom surface 48, the radial side surface 50, the chordal side surface 52, and the radial edge 54. The bottom surface 48 contains a threaded aperture 56 therein.

The reference to the side surface 50 and radial edge 54 as being generally radial means that the surface or the edge extends in a generally, although not precisely, radial fashion relative to (or from) the longitudinal axis of the bit body. The reference to the side surface 52 being generally chordal means that this surface extends in a generally, although not precisely, chordal fashion with respect to the generally circular periphery provided by the forward surface 37 of the bit body 32.

The radial side surface 50 does not have a juncture with the radial edge 54 because they have a relative orientation such that their intersection would exist at a point into the central passage 40. The radial side surface 50 has a juncture with the chordal side surface 52 so as to define a first junction 57 which is near the peripheral surface of the bit body 32. As becomes apparent from the discussion below, the seat 46 is at its deepest height (i.e., the seat has its greatest depth) at the first junction 57 since the seat 46 becomes deeper as it moves from the radial edge 54 to the first junction 57. In the specific embodiment shown in FIG. 3, the chordal side surface 52 does not have a juncture with the radial edge 54 because they have a relative orientation such that their intersection would exist at a point radially outside of the peripheral surface of the bit body. The seat 46 is at its shallowest height along the radial edge 54.

Referring back to the radial side surface 50, as shown in FIG. 3, it typically increases in height as it moves (generally) radially outwardly from the longitudinal axis toward the peripheral surface 42 of the bit body 32. The extent of the change in height depends upon the difference in the orientation of the bottom surface 48 of the seat 46 with the orientation of the forward surface 37 of the bit body 32.

Referring to the chordal side surface 52, it increases in height as it moves from the peripheral surface 42 toward its juncture 57 with the radial side surface 50. This increase in height is due to the orientation of the bottom surface 48 of the seat 46. The bottom surface 48 has an orientation so as to present a lead angle and a rake angle that orients the cutting insert 60 when in the seat 46 so that the cutting insert 60 has an insert rake angle "B" and an insert lead angle "C". The radial edge 54 is flush with the forward surface 37 of the bit body 32 along it entire length, but as mentioned above, applicants do not contemplate limiting the invention to where the radial edge 54 is flush with the forward surface 37.

Referring to FIGS. 1 and 2, it is preferable that rotatable cutting bit 30 mechanically retains cutting insert 60, which is indexable and presents a generally triangular shape. Even though mechanical retention is the preferred way to retain the cutting insert to the cutting bit, applicants do not intend to limit the invention to mechanical retention via a screw only, but expect to include other mechanical means for retention such as a lock pin arrangement, and other non-mechanical means such as epoxying, soldering, and even brazing when suitable. While a cutting insert of a generally triangular shape is the preferred geometry for the cutting insert, applicants contemplate that the cutting insert can take on other geometries such as any polygonal shape. Applicants also contemplate that the cutting insert may not be indexable and/or reversible, and may even take on an asymmetric shape.

FIGS. 1 and 2 show that there are three identical cutting inserts 60 so that a description of one cutting insert will suffice for all. Cutting insert 60 has a top surface 62, a bottom surface (not illustrated), a first generally radial side surface 66, a second generally chordal side surface 68, and a third generally radial side surface 70. First radial side surface 66 intersects the second chordal side surface 68 to form a first edge 72 which functions as the side clearance cutting edge when the cutting insert 60 is positioned in the bit body 32 as shown in FIGS. 1 and 2. The function of the side clearance cutting edge will be discussed in more detail hereinafter. Second chordal side surface 68 intersects with the third radial side surface 70 so as to form a second edge 74 which is radially inward of the peripheral edge of the bit body. The first radial side surface 66 intersects the third radial side surface 70 so as to form a third edge 76 which is near the central longitudinal axis of the bit body 32.

The first radial side surface 66 intersects with the top surface 62 to form a first cutting edge 80, which in the orientation illustrated in FIG. 1 and 2 is a leading cutting edge and the function thereof will be described in more detail hereinafter. The second chordal side surface 68 intersects with the top surface 62 to form a second cutting edge 82 when in the orientation of FIGS. 1 and 2. The third radial side surface 70 intersects the top surface 62 to form a third cutting edge 84 when in the orientation of FIGS. 1 and 2.

Cutting insert 60 contains an aperture 88 therein. Each cutting insert 60 is preferably mechanically retained in its respective seat by the use of a pin or a screw 90 which passes through the aperture 88 and is received in the aperture 56 in the bottom surface 48 of the seat 46. Though less preferred, applicants contemplate that other ways (e.g., press fitting, brazing) to retain the cutting insert to the cutting bit could be suitable for use herein.

There are three fundamental angles which describe the orientation of the cutting insert 60 in the seat. These angles are the lead angle "C", the insert rake angle "B", and the radial rake angle "D".

Referring to FIG. 1, the lead angle "C" is defined as the included angle between a line E—E along the leading cutting edge of the cutting insert and a line F—F parallel to the center of rotation of the cutting bit and passing along the peripheral surface 42 of the bit body 32. The line E—E is the lead angle reference line. The lead angle "C" can range between 50 degrees and 90 degrees. The preferred lead angle "C" is 70 degrees.

The insert rake angle "B" (see FIG. 1) is defined as the included angle between a line I—I normal to both the lead angle reference line E—E and line A—A and a line H—H lying along the top surface of the cutting insert 60 passing through the center "J" of the leading cutting edge and the center "K" of the second edge 74 wherein angle "B" is measured in the vicinity of "K". When the cutting insert has an orientation such that line H—H is leading line I—I upon forward penetration of the cutting bit in the direction of axial penetration, shown by arrow "Y", which occurs during drilling (i.e., line H—H is above line I—I), the insert rake angle "B" is positive. In the case where the cutting insert would have such an orientation that line H—H is trailing line I—I upon forward penetration of the cutting bit in the direction of axial penetration, shown by arrow "Y", which occurs during drilling (i.e., line H—H is below line I—I as shown in FIG. 1), the insert rake angle "B" would be negative. The insert rake angle "B" varies from between a minimum of about 0 degrees (where lines I—I and H—H are coaxial) to a maximum of about negative 30 degrees (where line H—H trails line I—I by 30 degrees as shown in FIG. 1). The preferred insert rake angle "B" is about negative 20 degrees.

The radial rake angle "D" is defined as the included angle between a radial line L—L from the central longitudinal axis A—A of the bit body which passes through the center "J" of the leading cutting edge of the cutting insert and a line M—M formed along the leading cutting edge 80 of the cutting insert 60 projected onto a plane perpendicular to centerline A—A (see FIG. 2). When the cutting insert has an orientation at a point radially outwardly of the circumference of the cutting bit (i.e., the point where angle "D" is measured) where line M—M is trailing line L—L upon rotation of the cutting bit in the direction of rotation shown by arrow "W" (which is the case as shown in FIG. 2), the radial rake angle "D" is negative. When the cutting insert has an orientation at a point radially outwardly of the circumference of the cutting bit (i.e., the point where angle "D" is measured) where line M—M is leading line L—L upon rotation of the cutting bit in the direction of rotation shown by arrow "W", the radial rake angle "D" is positive. The radial rake angle "D" can vary between a minimum of about positive 20 degrees (i.e., an orientation in which line M—M leads line L—L by 20 degrees) to a maximum of about negative 30 degrees (i.e., an orientation in which line M—M trails line L—L by 30 degrees). The preferred radial rake angle "D" is about negative 10 degrees.

In use, each cutting insert 60 presents two cutting edges which provide for the principal cutting (or drilling) activity. The leading cutting edge 80 engages the earth strata and does most of the cutting of the earth strata. The edge 76 of the cutting insert also provides a starting contact point so as to reduce the amount of "walking" which may occur when starting to cut (or drill) a hole. The second cutting edge 82 and the third cutting edge 84 do not participate to a significant degree in the cutting function.

The clearance cutting edge 72, which extends radially past the peripheral surface, functions to cut the diameter of the hole and thereby provide for clearance between the peripheral surface 42 of the cutting bit 30 and the surface of the earth strata which defines the hole being cut. The second edge 74 and the third edge 76, except for providing a starting point, do not participate to a significant degree in the cutting function.

Cutting insert 60 is indexable. Thus, when cutting insert 60 is indexed counter-clockwise (see FIG. 2), the second edge 74 then functions as the side clearance cutting edge. The second cutting edge 82 then functions as the leading cutting edge.

Where the cutting inserts are mechanically retained, the disadvantages associated with brazed-on cutting inserts are absent. Consequently, wear resistant materials, which have heretofore not been candidates for use in a roof drill bit, are now realistic candidates for cutting inserts. In this regard, exemplary materials include ceramics, low binder content (3 to 6 weight percent) tungsten carbide, binderless tungsten carbide, diamond or hard (chemical vapor deposition or physical vapor deposition) coated cemented carbides or ceramics, polycrystalline diamond [PCD] composites with a metallic binder (e.g., cobalt), polycrystalline diamond [PCD] composites with a ceramic binder (e.g., silicon nitride), and polycrystalline cubic boron nitride [PcBN] composites.

Figure 4:
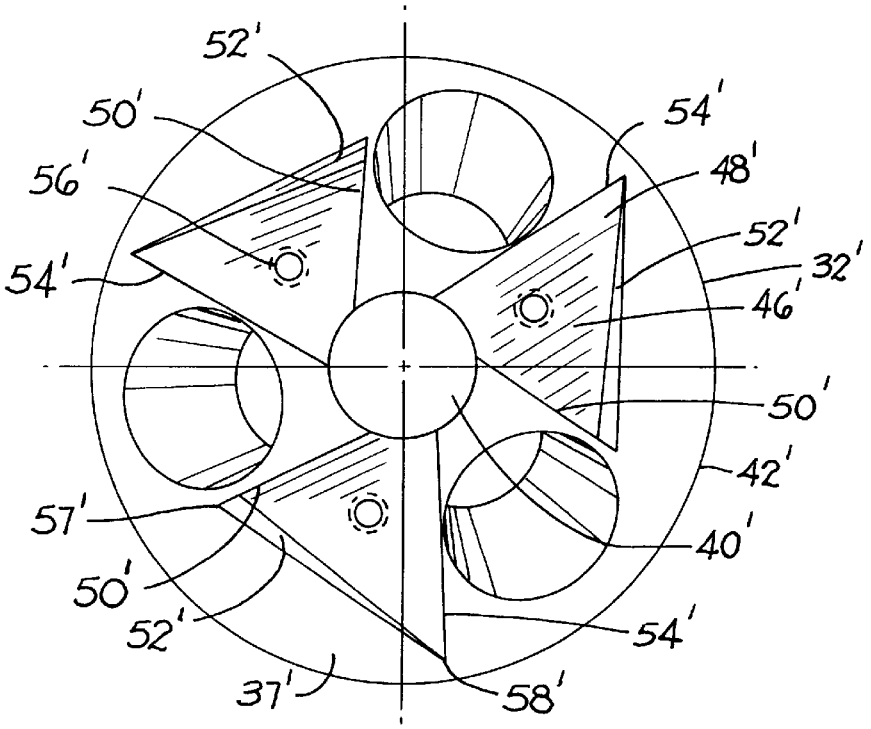
FIG. 4 is a top view of a second embodiment of the cutting bit body.

Referring to FIG. 4 there is shown a second specific embodiment of the cutting bit body 32'. The principal difference between the second embodiment and the first embodiment of the bit body is that the seat of the second embodiment terminates radially inwardly of the peripheral surface. For structural features common between the first and second embodiments of the bit body, the reference numerals for the second embodiment are the same as those for the first, but are primed.

Cutting bit body 32' contains a seat 46' which presents a generally triangular shape. Seat 46' has a bottom surface 48'. Seat 46' also presents a generally radial side surface 50', a generally chordal side surface 52', and a generally radial edge 54'. The seat 46' is defined by the bottom surface 48', the radial side surface 50', the chordal side surface 52', and the radial edge 54'. The bottom surface 48' contains a threaded aperture 56' therein. The reasons for describing these edges as radial or chordal are the same as for the description of the first specific embodiment of the cutting bit body. The radial edge 54' intersects with the chordal side surface 52' to define a juncture 58' wherein juncture 58' is radially inward of the peripheral surface of the bit body. The chordal side surface 52' intersects with the radial side surface 50' to define a juncture 57'. The radial side surface 50' and the radial edge 54' do not intersect because they have a relative orientation such that their intersection would exist at a point into the central passageway 40'.

Even though juncture 58' of the seat 46' terminates radially inwardly of the peripheral surface 42' of the bit body 32', the seat 46' has an orientation such that the side clearance cutting edge of a cutting insert still extends radially past the peripheral surface of the bit body. In this regard, seat 46' has a lead angle and a rake angle which orients the cutting insert therein in the desired disposition.

Figure 5:
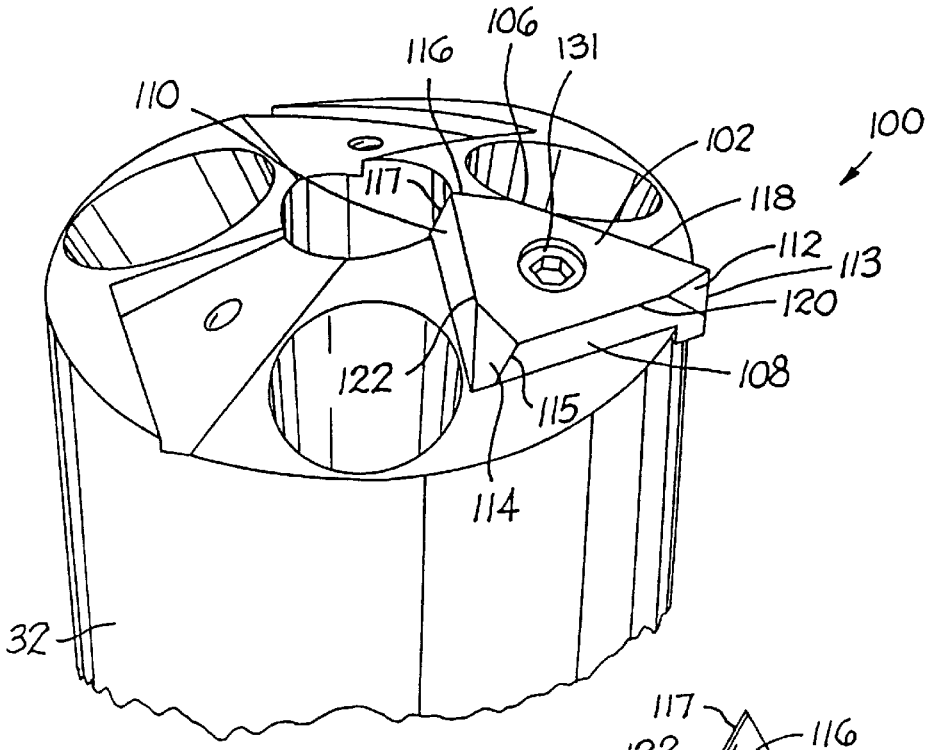
FIG. 5 is an isometric view of the forward part of another specific embodiment of a rotatable cutting bit using the cutting bit body of FIG. 1 and a second specific embodiment of a cutting insert.
Figure 6:
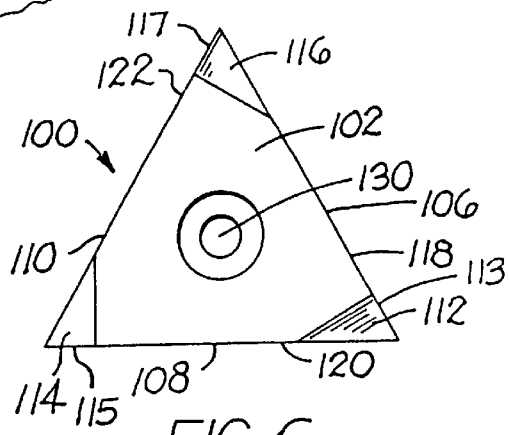
FIG. 6 is a top view of the cutting insert from the specific embodiment of FIG. 5.

Referring to FIGS. 5 through 8, there is shown a second specific embodiment of a cutting insert generally designated as 100. For the sake of clarity FIG. 5 depicts the presence of only one cutting insert 100 and two empty seats 46; however, in actual use the cutting bit body 32 would contain three cutting inserts 100 with a cutting insert in each seat.

Figure 8:
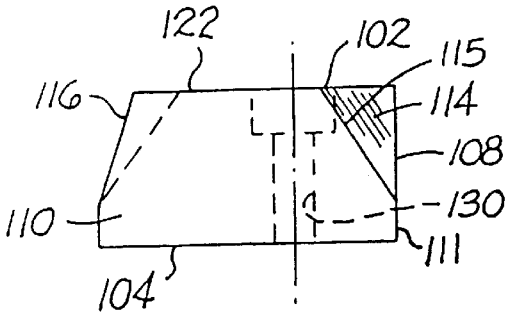
FIG. 8 is a left side view of the cutting insert of FIG. 5.
Figure 7:
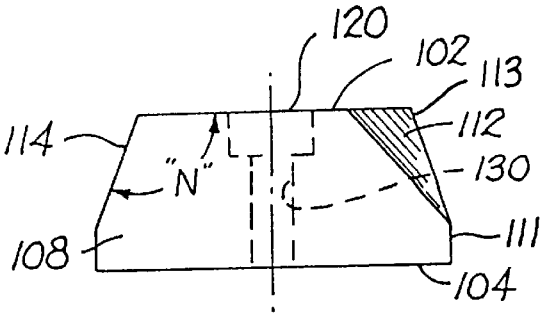
FIG. 7 is a front view of the cutting insert of FIG. 5.

Cutting insert 100 has a top surface 102 and a bottom surface 104, as well as a first side surface 106, a second side surface 108, and a third side surface 110. The first side surface 106 and the third side surface 110 each have a generally radial orientation in that each one extends from a position near the central axis of the bit body 32 toward the peripheral surface 42 thereof. The second side surface 108 has a generally chordal orientation in that it generally extends along a line that extends between two points on the peripheral surface 42 of the bit body 32. Each one of the side surfaces 106, 108, 110 has a generally vertical wall (or rim) 111 portion as shown in FIGS. 7 and 8. As described hereinafter, the presence of this vertical rim 111 facilitates the pressing of the cutting insert from powder components if the cutting insert is formed through powder metallurgical techniques. However, it should be appreciated that the rim 111 is not a mandatory feature, but optional, depending upon the manufacturing method used to make the cutting insert.

The cutting insert 100 also presents a first bevelled surface 112 at the juncture of the first side surface 106 and the second side surface 108, a second bevelled surface 114 at the juncture of the second side surface 108 and the third side surface 110, and a third bevelled surface 116 near the juncture of the third side surface 110 and the first side surface 106. Each bevelled surface (112, 114, 116) is disposed with respect to the top surface 102 of the cutting insert at an included angle "N" (see FIG. 7) of about 110 degrees. Included angle "N" may vary between about 90 degrees and about 130 degrees depending upon the lead angle of the cutting insert for reasons expressed below.

The top surface 102 intersects with the first side surface 106 to form a first cutting edge 118. The top surface 102 intersects with the second side surface 108 to form a second cutting edge 120. The top surface 102 intersects with the third side surface 110 to form a third cutting edge 122. The cutting insert 100 contains an aperture 130 therein through which a screw 131 passes so as to mechanically retain the cutting insert to the bit body.

When in the position shown by FIG. 5, the first cutting edge 118 is the leading cutting edge. The second cutting edge 120 and the third cutting edge 122 do not participate significantly in the cutting operation. The intersection of the first bevelled surface 112 and the first side surface 106 functions as the clearance cutting edge 113. Typically, the included angle "N" corresponds to the lead angle in that it approximately equals 180 degrees less the amount of the lead angle. Because of this relationship, when the cutting insert 100 is in seat 46, the first bevelled surface 112 has an orientation that is generally parallel to the longitudinal axis A—A of the bit body 32. In such an orientation the bevelled surface 112 intersects with the first side surface 106 so as to define a first side clearance cutting edge 113 at such intersection. The cutting of the diameter of the hole is done over the first side clearance cutting edge 113. Typically, there is at least a small amount of relief of the first side clearance cutting edge 113.

The cutting insert 100 is indexable. When the cutting insert 100 is indexed counterclockwise (see FIG. 5), the second cutting edge 120 becomes the leading cutting edge and the second bevelled surface 114 intersects the second side surface 108 to form a second side clearance cutting edge 115 at such intersection. The cutting of the hole diameter is done over the second side clearance cutting edge 115. When the cutting insert 100 is again indexed in a counterclockwise direction (see FIG. 5), the third cutting edge 122 becomes the leading cutting edge. Furthermore, the third bevelled surface 116 intersects the third side surface 110 so as to form a third side clearance cutting edge 117 at such intersection. The cutting of the diameter of the hole is done over the third side clearance cutting edge 117.

Referring to FIGS. 9 through 12 there is shown a third specific embodiment of the cutting insert generally designated as 140. Cutting insert 140 has a top surface 142 and a bottom surface 144, as well as a first side surface 146, a second side surface 148, and a third side surface 150. When in the position shown by FIG. 9, the first side surface 146 and the third side surface 150 have a generally radial orientation in that each surface (146, 150) extends from a point near the central longitudinal axis of the bit body 32 toward the peripheral edge 42 of the forward surface of the bit body 32. Each one of the side surfaces 146, 148, 150 has a generally vertical wall (or rim) 151 portion. As described hereinafter, the presence of this vertical rim 151 facilitates the pressing of the cutting insert from powder components if the cutting insert is formed through powder metallurgical techniques. Like mentioned above, however, the presence of the rim 151 is an optional feature depending upon the manufacturing method of the cutting insert.

The cutting insert 140 also presents a first relieved surface 152 at the juncture of the first side surface 146 and the second side surface 148, a second relieved surface 154 at the juncture of the second side surface 148 and the third side surface 150, and a third relieved surface 156 at the juncture of the third side surface 150 and the first side surface 146. The degree of the relief may vary depending upon the specific application. The preferred degree of relief is such that when the cutting insert is in the seat, each relieved surface intersects with its corresponding side surface so as to define a side clearance cutting edge that is generally parallel to the peripheral surface of the cutting bit body. The relieved surfaces (152, 154, 156) may be entirely arcuate as shown or, in the alternative, each relieved surface may have a planar portion adjacent to the side surface of the cutting insert which blends into an arcuate portion as the relieved surface moves around the periphery of the cutting insert.

The top surface 142 intersects with the first side surface 146 to form a first cutting edge 158. The top surface 142 intersects with the second side surface 148 to form a second cutting edge 160. The top surface 142 intersects with the third side surface 150 to form a third cutting edge 162. The cutting insert 140 contains an aperture 170 therein through which a screw 171 passes so as to mechanically retain the cutting insert 140 to the bit body 32. When in the position shown by FIG. 9, the first cutting edge 158 is the leading cutting edge, and the first relieved surface 152 intersects with the first side surface 146 to form a first side clearance cutting edge 153. When in the position illustrated in FIG. 9, the second and third cutting edges (160, 162) do not participate to a significant extent in the cutting operation.

Figure 9:
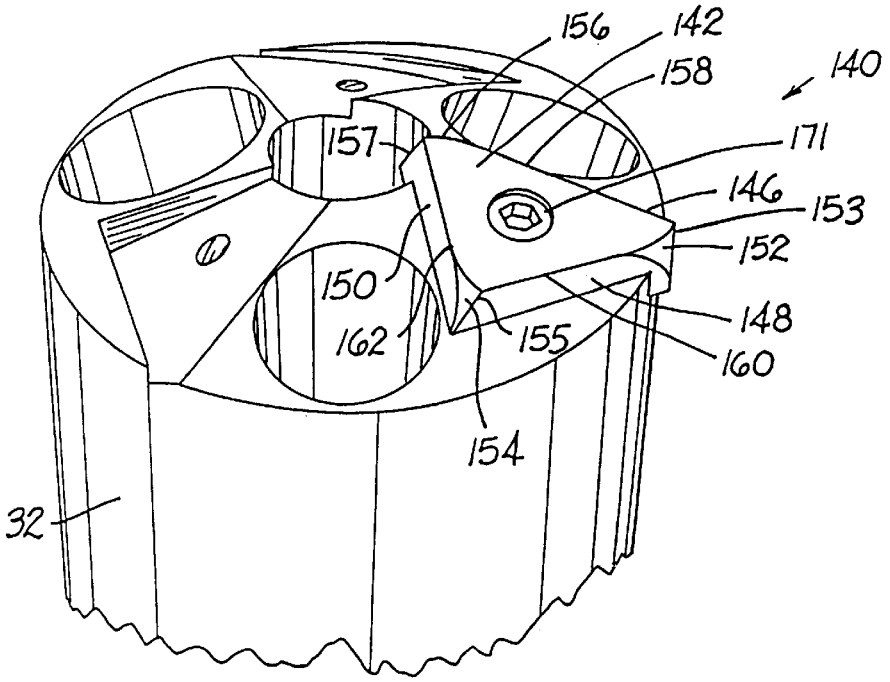
FIG. 9 is an isometric view of the forward part of a specific embodiment of a rotatable cutting bit using the cutting bit body of FIG. 1 and a third specific embodiment of a cutting insert.
Figure 10:
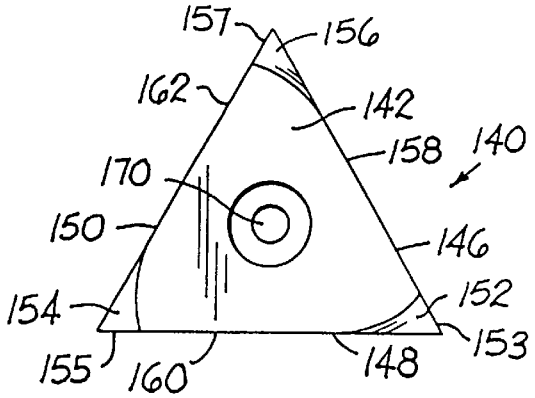
FIG. 10 is a top view of the cutting insert of FIG. 9.
Figure 12:
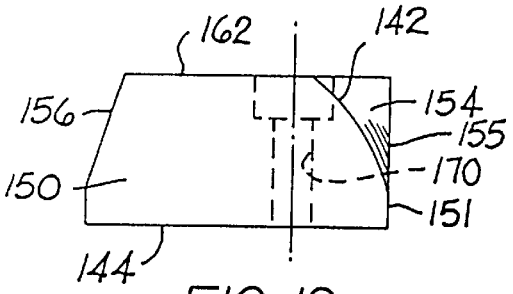
FIG. 12 is a left side view of the cutting insert of FIG. 9.
Figure 11:
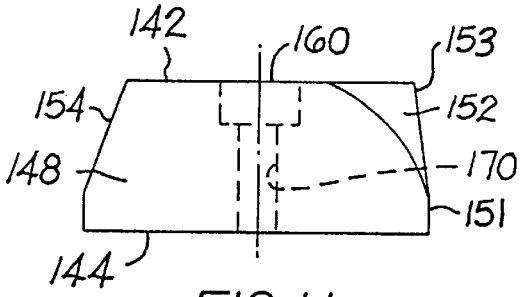
FIG. 11 is a front view of the cutting insert of FIG. 9.
Figure 13:
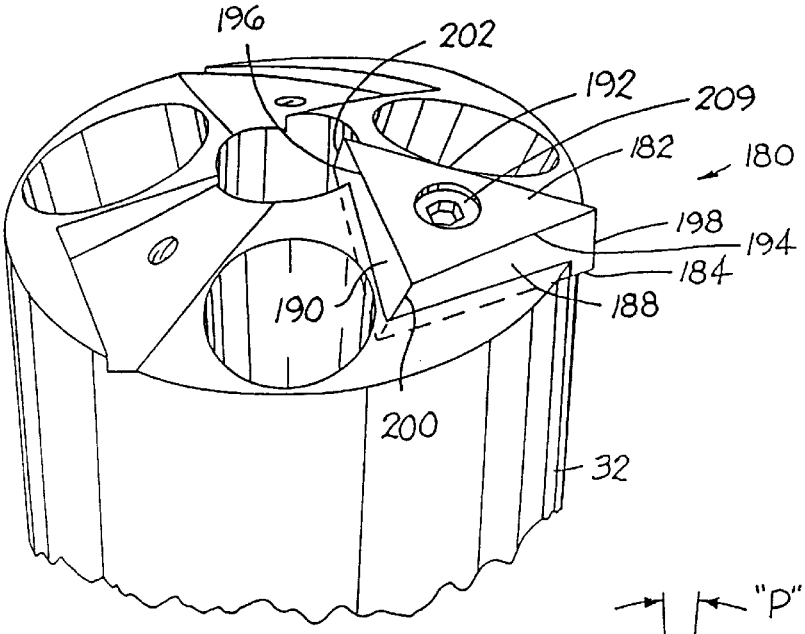
FIG. 13 is an isometric view of the forward part of a specific embodiment of a rotatable cutting bit using the cutting bit body of FIG. 1 and a fourth specific embodiment of a cutting insert.
Figure 14:
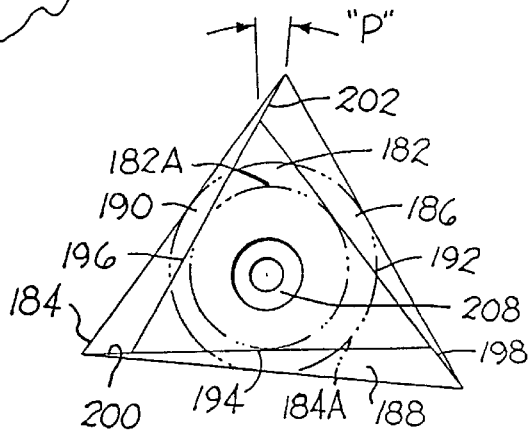
FIG. 14 is a top view of the cutting insert of FIG. 13.
Figure 16:
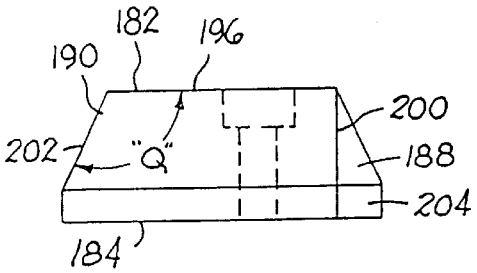
FIG. 16 is a left side view of the cutting insert of FIG. 13.
Figure 15:
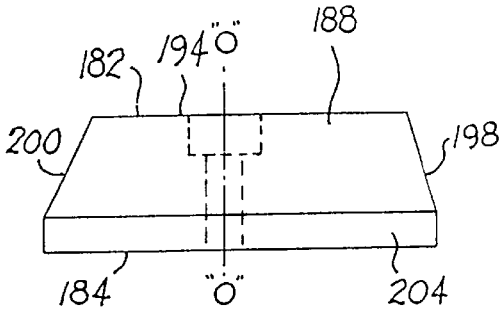
FIG. 15 is a front view of the cutting insert of FIG. 13.

Like for the second embodiment of the cutting insert, the third embodiment of the cutting insert 140 is indexable. When indexed in a counterclockwise direction as shown in FIG. 9., the second cutting edge 160 becomes the leading cutting edge and the second relieved surface 154 intersects the second side surface 148 so as to define a second side clearance cutting edge 155. The cutting insert 140 may be indexed again in a counterclockwise direction (see FIG. 9) so that the third cutting edge 162 is the leading cutting edge. The third relieved surface 156 intersects the third side surface 150 so as to define a third side clearance cutting edge 157 at the intersection thereof. The cutting of the diameter of the hole is done by one of the three side clearance cutting edges (153, 155, 157) depending upon the position of the cutting insert.

Referring to FIGS. 13 through 16, there is illustrated a fourth specific embodiment of a cutting insert, generally designated as 180, intended to be used with the bit body 32 depicted in FIG. 1. Cutting insert 180 has a generally equilateral triangular top surface 182 and a generally equilateral triangular bottom surface 184. The inscribed circle 182A, i.e., the largest circle which can be imposed in the inside of the cutting insert, of the top surface 182 is less than the inscribed circle 184A of the bottom surface 184. Furthermore, the top surface is rotated about a central axis O—O perpendicular to the top surface 182 and relative to the bottom surface 184 about 6 degrees as shown by angle "P" in FIG. 14. Angle "P" is defined as the included angle between two lines wherein both lines originate from axis O—O of cutting insert 180. One line passes through the point where edge 202 intersects the top surface 182 of the cutting insert and lies in a plane perpendicular to axis O—O and in which the above-mentioned point of intersection (edge 202 intersects top surface 182) lies. The other line passes through the point where edge 202 intersects the bottom surface 184 of the cutting insert and lies in a plane perpendicular to axis O—O and in which the above-mentioned point of intersection (edge 202 intersects bottom surface 184) lies. To define angle "P", the lines are projected so as to lie in the same plane which is perpendicular to the axis O—O.

The cutting insert 180 has a first side surface 186, a second side surface 188, and a third side surface 190. Because of the rotation of the top surface 182 relative to the bottom surface 184, the orientation of each side surface (186, 188, 190) relative to the top surface 184 of the cutting insert 180 changes along the length of the side surface (186, 188, 190) as will be discussed hereinafter.

The top surface 182 of the cutting insert 180 intersects with the first side surface 186 to form a first cutting edge 192. The top surface 182 of the cutting insert 180 intersects with the second side surface 188 to form a second cutting edge 194. The top surface 182 of the cutting insert 180 intersects with the third side surface 190 to form a third cutting edge 196.

The first side surface 186 and second side surface 188 intersect to form a first cutting edge 198. The second side surface 188 and third side surface 190 intersect to form a second cutting edge 200. The third side surface 190 and first side surface 186 intersect to form a third cutting edge 202.

Referring to the orientation of the first side surface 186, when the side surface 186 is at the edge 198 it has an orientation so as to be generally perpendicular to the top surface 182 of the cutting insert 180. At the edge 202, first side surface 186 has an orientation so as to have an included angle "Q" between itself and the top surface 182 of about 110 degrees. Over the length of the side surface 186, the orientation thereof consistently changes from being generally perpendicular to the top surface 182 to being disposed at about 110 degrees from the top surface 182.

The same orientation, and change of orientation over the length, exists for the other two side surfaces. In this regard, second side surface 188 has a generally perpendicular orientation with respect to the top surface at edge 200. The orientation of second side surface 188 changes along its length from edge 200 toward edge 198 so that at edge 198 side surface 188 is disposed at an included angle of about 110 degrees with respect to the top surface 182. Third side surface 190 has a generally perpendicular orientation with respect to the top surface at edge 202. The orientation of third side surface 190 changes along its length from edge 202 toward edge 200 so that at edge 200 side surface 190 is disposed at an included angle of about 110 degrees with respect to the top surface 182. The maximum included angle of disposition (e.g., included angle "Q") may range between about 90 degrees and about 130 degrees depending upon the lead angle of the cutting insert. The preferred angle of disposition "Q" is about 110 degrees. Typically, this angle of disposition corresponds to the lead angle in that included angle "Q" equals 180 degrees less the amount of the lead angle. Because of this relationship, when the cutting insert 180 is in seat 46, the first edge 198 has an orientation that is generally parallel to the longitudinal axis A—A of the bit body 32. Such an orientation permits the first edge 198 to present a side clearance cutting edge wherein the cutting of the diameter of the hole is done over the clearance cutting edge.

The cutting insert 180 has a generally vertical wall (or rim 204) portion near the bottom of each one of the side surfaces (186, 188, 190). As will be mentioned hereinafter, the presence of the vertical rim facilitates the pressing of the powder components of the cutting insert if it is made via powder metallurgical techniques. As mentioned above, the presence of the rim 204 is an optional feature depending upon the manufacturing method. The cutting insert 180 contains an aperture 208 through which passes a screw 209 that mechanically retains the cutting insert 180 to the bit body. In the orientation shown in FIG. 13, the first cutting edge 192 functions as the leading cutting edge and the first edge 198 functions as the side clearance cutting edge. Like for earlier cutting inserts, this embodiment of the cutting insert 180 is indexable. When cutting insert 180 is indexed counterclockwise (see FIG. 13), the second cutting edge 194 functions as the leading cutting edge and the second edge 200 functions as the side clearance cutting edge.

Referring to FIGS. 17 through 20 there is illustrated a fifth specific embodiment of the cutting insert, generally designated as 216, which is suitable for use with the bit body 32 of FIG. 1. Cutting insert 216 is a reversible cutting insert.

Figure 17:
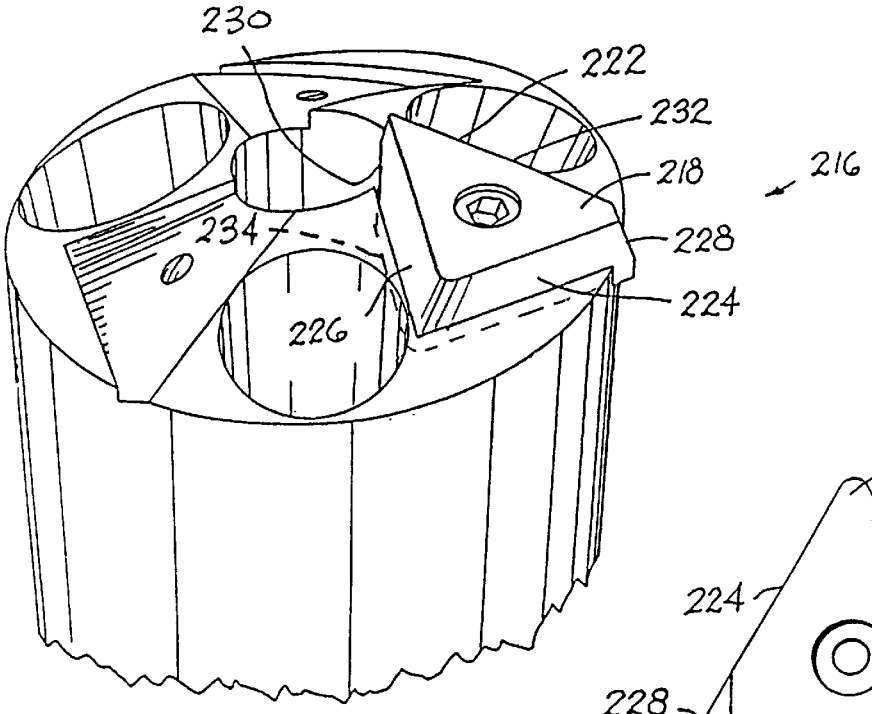
FIG. 17 is an isometric view of the forward part of a specific embodiment of a rotatable cutting bit using the cutting bit body of FIG. 1 and a fifth specific embodiment of a cutting insert.
Figure 18:
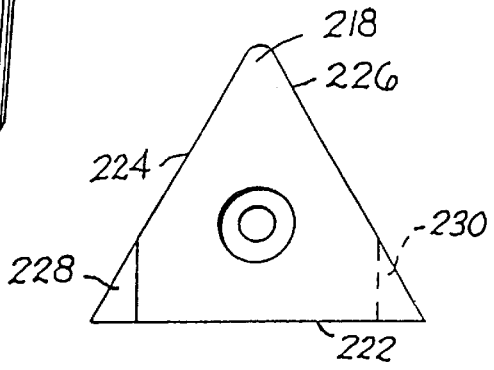
FIG. 18 is a top view of the cutting insert of FIG. 17.
Figure 20:
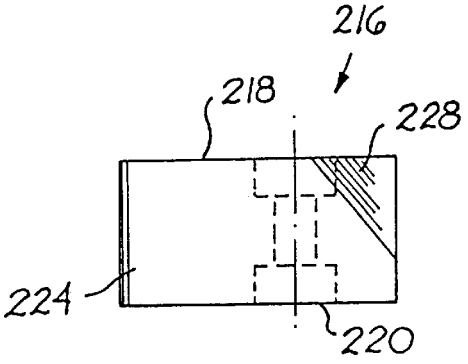
FIG. 20 is a left side view of the cutting insert of FIG. 18.
Figure 19:
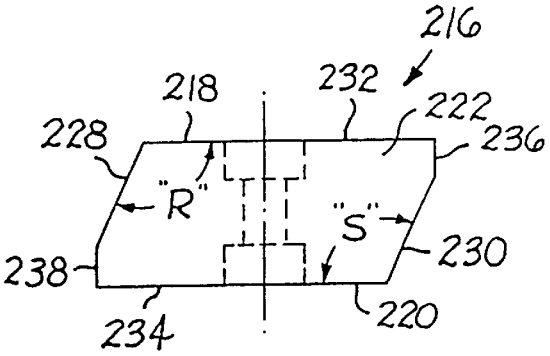
FIG. 19 is a front view of the cutting insert of FIG. 18 taken along line 19—19 of FIG. 18.

In the orientation shown in FIGS. 17 and 20, cutting insert 216 has a top surface 218 and a bottom surface 220. Cutting insert 216 also has a first side surface 222, a second side surface 224, and a third side surface 226. There is a first bevelled surface 228 at the juncture of the first side surface 222 and the second side surface 224 wherein the bevelled surface 228 is near the top surface 218 of the cutting insert 216. There is a second bevelled surface 230 at the juncture of the third side surface 226 and the first side surface 222 wherein the bevelled surface 230 is near the bottom surface 220 of the cutting insert 216. The top surface 218 intersects the first side surface 222 to from a first cutting edge 232. The bottom surface 220 intersects the first side surface 226 to form a second cutting edge 234.

The first bevelled surface 228 is disposed with respect to the top surface 218 at an included angle "R" equal to about 110 degrees. The second bevelled surface 230 is disposed with respect to the bottom surface 220 at an included angle "S" equal to about 110 degrees. Included angles "R" and "S" may range between about 90 degrees and about 130 degrees depending upon the lead angle of the cutting insert. The cutting insert has a top rim 236 of material about a portion of the top surface 218. The cutting insert has a bottom rim 238 of material about a portion of the bottom surface 220. As will be mentioned hereinafter, the presence of the top rim 236 and the bottom rim 238 facilitates the pressing of the powder components of the cutting insert if the cutting insert is made via powder metallurgical techniques. The rims 236, 238 are optional features depending upon the method for manufacturing the cutting insert.

When the cutting insert 216 is oriented so that the top surface 218 is in an exposed position, the first bevelled surface 228 defines the side clearance cutting edge and the first cutting edge 232 is the leading cutting edge. When the cutting insert 216 is oriented so that the bottom surface 220 is in an exposed position, the second bevelled surface 230 defines the side clearance cutting edge and the second cutting edge 234 is the leading cutting edge.

In order to demonstrate the performance of the roof drill bit of the instant invention using cutting inserts with different grades of cemented tungsten carbide (see Compositions Nos. 1, 2, 3 and 4 in Table I) as compared with a conventional style of roof drill bit using a cutting insert in one grade of cemented tungsten carbide (i.e., Composition No. 1 in Table I).

TABLE I

Compositions and Physical Properties of Compositions Nos. 1–4

| Grade | Cobalt | Ti | Ta | Nb | Other | $H_C$ | $R_A$ |
|---|---|---|---|---|---|---|---|
| Comp. No. 1 | 6.2 | <.2 | .3 | <.2 | — | 115 | 89.7 |
| Comp. No. 2 | 6.0 | <.1 | <.1 | <.1 | V = 0.2 | 350 | 93.3 |
| Comp. No. 3 | 7.9 | <.2 | .3 | <.2 | — | 110 | 89.4 |
| Comp. No. 4 | 5.7 | <.2 | 1.9 | <.3 | — | 265 | 92.7 |

The compositions are set forth in weight percent wherein the balance of each one of the above compositions is tungsten carbide. The coercive force ($H_C$) is set forth in oersteds and the hardness is set forth in Rockwell A.

The test results are set forth in Table II below. In this regard, in Table II Comparative Bit No. 1 was a roof drill bit made by Kennametal Inc. of Latrobe, Pa. (USA) under the designated KCV4-1 (see Kennametal Mining Products Catalog A96-55(15)H6 at page 20) using a cemented tungsten carbide cutting insert of Composition No. 1, as set forth above. In Table II, Comparative Bit No. 2 was a roof drill bit made by Kennametal Inc. of Latrobe, Pa. (USA) under the designated KCV4-1RR (Roof Rocket) [see Kennametal Mining Products Catalog A96-55(15)H6 at page 20] using a cemented tungsten carbide cutting insert of Composition No. 1, as set forth above.

Invention Nos. 1, 2, 3, and 4 in Table II below were each a roof drill bit with a structure along the lines of the specific embodiment of FIG. 1 using a tungsten carbide cutting insert of Composition Nos. 1, 2, 3 and 4 (Table I), respectively.

TABLE II

Test Results for Drilling in Sandstone

| Sample | Rotational Speed (RPM) | Hole Depth (inches) | Average Feed Rate (in/second) | Average Thrust (lbs.) | Average Torque (in-lbs) |
|---|---|---|---|---|---|
| Invention No. 1 | 406 | 164.6 | 2.1 | 2479 | 1145 |
| Invention No. 2 | 418 | 165.1 | 1.99 | 2137 | 1125 |
| Invention No. 3 | 404 | 162.6 | 2.16 | 2403 | 1209 |
| Invention No. 4 | 401 | 166.7 | 1.96 | 2342 | 1323 |
| Comparative No. 1 | 418 | 165 | 1.34 | 2619 | 919 |
| Comparative No. 2 | 409 | 157.2 | 1.68 | 2433 | 1104 |

The test results and parameters comprise the rotational speed in revolutions per minute (RPM), the depth of the hole in inches at the completion of the test, the average feed rate of the drill bit in inches per second (in./second), the average thrust of the drill bit into the substrate in pounds (lbs.), and the average torque of the drill bit in inch-pounds (in-lbs). The test results show that the penetration rates for the roof drill bits of the invention are meaningfully higher than for the conventional roof drill bits. A comparison of the roof drill bit of the invention (Invention No. 1) against the conventional KCV4-1 roof drill bit in the same carbide grade shows that the present invention had a penetration rate of 2.1 inches/second at an average thrust of 2479 lbs. as compared to a penetration rate of 1.34 inches/second at a slightly higher average thrust of 2619 lbs. The present invention experienced an increase in penetration rate of about 56.7 percent at a somewhat lower average thrust. A comparison of the same roof drill bit (Invention No. 1) against the other conventional roof drill bit, i.e., KCV4-1RR (Roof Rocket) in the same carbide grade, reveals that the present invention experienced an increase in the penetration rate of about 25 percent at almost the same average thrust (2479 lbs. vs. 2433 lbs.).

A comparison of the roof drill bit of the specific embodiment of the invention tested against the KCV4-1 roof drill bit in different carbide grades shows that for all of the carbide grades tested the present invention had an increase in the penetration rate at a lesser average thrust. For the roof drill bit of the invention (Invention No. 2) having a lower cobalt content and higher hardness than the carbide grade of the conventional roof drill bit, there was an increase in the penetration rate of about 48.5 percent at an average thrust which was meaningfully lower (2137 lbs. vs. 2619 lbs.). For the roof drill bit of the invention (Invention No. 3) having a higher cobalt content and a similar hardness, the roof drill bit of the invention had an increase in the penetration rate of about 61.2 percent at a lower average thrust (2403 lbs. vs. 2619 lbs.). For the roof drill bit (Invention No. 4) having a lower cobalt content and a higher hardness there was an increase in the average penetration rate of about 46.3 percent at a lower average thrust (2342 lbs. vs. 2619 lbs.).

A comparison of the roof drill bit of the invention against the KCV4-1RR (Roof Rocket) roof drill bit in different carbide grades shows that for all of the carbide grades tested the present invention had an increase in the penetration rate at a lesser average thrust. For the roof drill bit of the invention (Invention No. 2) having a lower cobalt content and higher hardness than the carbide grade of the conventional roof drill bit, there was an increase in the penetration rate of about 18.4 percent at an average thrust which was lower (2137 lbs. vs. 2433 lbs.). For the roof drill bit of the invention (Invention No. 3) having a higher cobalt content and a similar hardness, the roof drill bit of the invention had an increase in the penetration rate of about 28.6 percent at about the same average thrust (2403 lbs. vs. 2433 lbs.). For the roof drill bit (Invention No. 4) having a lower cobalt content and a higher hardness there was an increase in the average penetration rate of about 16.7 percent at a lower average thrust (2342 lbs. vs. 2433 lbs.). These test results show that the roof drill bit of the present invention provides for an improvement in the average penetration rate while decreasing the magnitude of the average thrust.

Table III below sets forth the results of wear testing in sandstone of the cutting insert of roof drill bits according to the present invention, i.e., a roof drill bit with the structure depicted in FIG. 1 hereof, and conventional roof drill bits. The identification of the roof drill bits in Table III corresponds in structure and in the composition of the cutting insert to that of the roof drill bits of Table II. A wear scar was inscribed in each cutting insert and measured beginning at the plane of the original leading edge of the cutting insert to the point towards the trailing edge where wear was noted. The measurement was done at the outside diameter (OD) of the cutting edge and at the positions along the cutting edge the indicated distance (inches) away from the outside diameter until reaching the inside diameter (ID). The wear scar length was then normalized to the actual cut depth for each cutting edge. The results are set forth in Table III. The results are also plotted in FIG. 21.

TABLE III

Normalized Wear Scar (Inches) Test Results

| Roof Bit/Distance from O.D. | O.D. | 0.016 (in.) | 0.03 (in.) | 0.045 (in.) | 0.08 (in.) |
|---|---|---|---|---|---|
| Invention No. 1 | −0.13 | −0.10 | −0.10 | −0.10 | −0.10 |
| Invention No. 3 | −0.17 | −0.11 | −0.11 | −0.11 | −0.10 |
| Invention No. 2 | −0.07 | −0.03 | −0.01 | −0.01 | 0.00 |
| Invention No. 4 | −0.17 | −0.08 | −0.05 | −0.03 | −0.02 |
| Comparative No. 1 | −0.21 | −0.18 | −0.18 | −0.12 | −0.12 |
| Comparative No. 2 | −0.12 | −0.09 | −0.08 | −0.08 | −0.08 |

| Roof Bit/ Distance from O.D. | 0.09 (in.) | 0.12 (in.) | 0.18 (in.) | 0.3 (in.) | I.D. |
|---|---|---|---|---|---|
| Invention No. 1 | −0.10 | −0.10 | −0.09 | −0.08 | −0.07 |
| Inventicn No. 3 | −0.10 | −0.10 | −0.09 | −0.09 | −0.09 |
| Invention No. 2 | −0.00 | −0.00 | −0.00 | −0.00 | 0.00 |
| Invention No. 4 | −0.02 | −0.01 | −0.01 | −0.01 | −0.01 |
| Comparative No. 1 | −0.10 | −0.09 | −0.07 | −0.05 | −0.04 |
| Comparative No. 2 | −0.08 | −0.07 | −0.06 | −0.04 | −0.04 |

Figure 21:
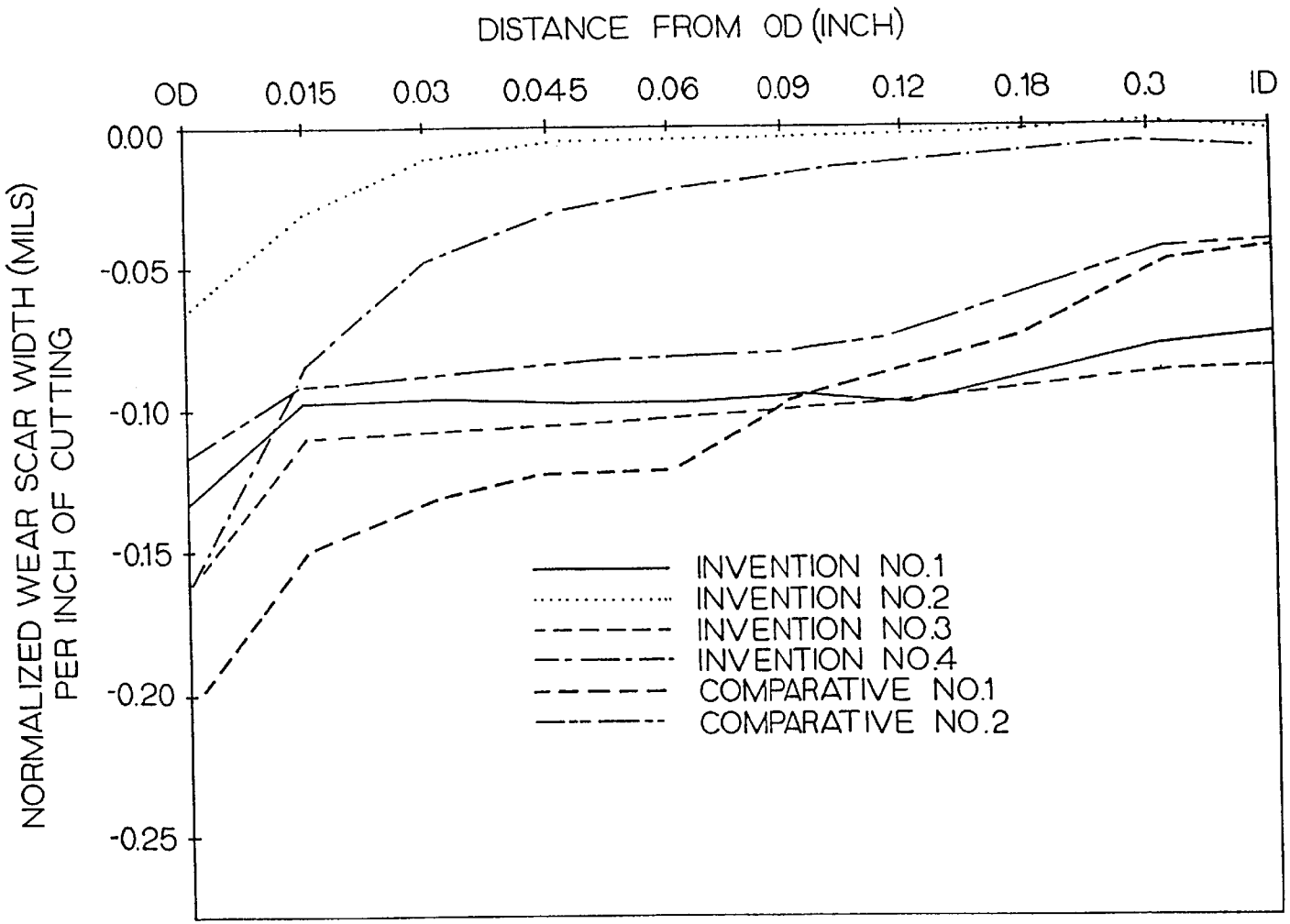
FIG. 21 is a graph comparing the normalized wear scar width (inches) against the distance (inches) from the outside diameter of the cutting insert.

These test results set forth in Table III, and plotted in FIG. 21, show that the amount of wear at the critical O.D. location is better for the roof drill bit of the invention than the KCV4-1 roof drill bit when using the same grade of carbide. In this regard, the wear for the invention is −0.13 as compared to −0.21 for the KCV4-1 roof drill bit. The wear between the roof drill bit of the invention and the KCV4-1RR is about the same with the conventional roof drill bit having a slightly better wear (−0.12 vs. −0.13). The harder carbide grade used in Invention No. 2 showed better wear against both styles of conventional roof drill bits. The grades used in Invention Nos. 3 and 4 showed better wear than the KCV4-1 roof drill bit (−0.17 vs. −0.21), but not as good as wear against the KCV4-1RR roof drill bit (−0.17 vs. −0.12).

Applicants contemplate using other compositions of cobalt cemented carbide for the cutting insert wherein these compositions include one composition comprising 6.0 weight percent cobalt with the balance being tungsten carbide, and having a coercive force ($H_C$) equal to 350 oersteds and a hardness equal to 93.3 Rockwell A. These compositions also include another composition comprising 5.7 weight percent cobalt with the balance being tungsten carbide, and a coercive force ($H_C$) equal to 265 oersteds and a hardness equal to 92.7 Rockwell A.

Furthermore, applicants contemplate using cobalt cemented tungsten carbide compositions wherein the hardness is greater than or equal to 90.5 (RA) Rockwell A or using cobalt cemented tungsten carbide compositions wherein the hardness is greater than or equal to 91 ($R_A$) Rockwell A. In addition, other compositions which applicants contemplate using a cobalt cemented tungsten carbide composition having a coercive force ($H_C$) greater than or equal to 160 oersteds, and a cobalt cemented tungsten carbide composition having a coercive force ($H_C$) greater than or equal to 180 oersteds.

It becomes apparent that applicants have provided an improved rotatable cutting bit, as well as an improved cutting insert and an improved bit body for a rotatable cutting bit. There are a number of advantages associated with the instant invention.

The mechanical retention of the cutting inserts to the bit body increases the number of materials which may now be viable candidates for use as the cutting insert. Some of these materials are identified above and their use provides an opportunity to improve the overall efficiency of the cutting or drilling operation.

The mechanical retention through the use of a screw passing through an aperture in the cutting insert so as to be received in a threaded aperture in the seat in the bit body makes it easy to attach or detach the cutting insert to or from the bit body. Thus, the operator in the mine environment may easily switch out used (or worn) cutting inserts for new (or reground) cutting inserts. The operator may also easily index the cutting insert to present a new leading cutting edge. The ability to easily make this switch (or index the cutting insert) in the mine environment without the need for special (or expensive) equipment will reduce the costs associated with the cutting operation.

In some of the embodiments the cutting insert presents a side clearance cutting edge which is generally parallel to the peripheral surface of the bit body, as well to the central longitudinal axis of the bit body. Due to this orientation, the side clearance cutting edge cuts the diameter of the hole along an edge surface and thus provides for adequate clearance between the bit body and the earth strata which defines the hole.

It is advantageous that the specific embodiments of the cutting inserts provide protection, at least to some extent, for the cutting edges which are not involved in the principal cutting activities. By providing this protection, the cutting ability of the cutting insert is not diminished when the cutting insert is indexed or reversed.

Specific embodiments of the cutting insert also provide for there to be a 90 degree corner (i.e., a vertical wall or rim) at the bottom surface of the indexable cutting inserts and at both the top and bottom surfaces of the reversible cutting insert. The existence of this 90 degree corner reduces the chance that the press operator will damage the tooling when forming the part via pressing a powder mixture because the rim allows clearance between the tooling punch and die set. The existence of the 90 degree corner also helps seat the cutting insert so that it is securely positioned within the seat.

Although the specific embodiment is a roof drill bit, it should be appreciated that applicants contemplate that the invention encompasses other styles of rotatable cutting bits. One such example is a rotary percussive drill bit. In addition, although the cutting inserts are either indexable or reversible, applicants contemplate that the invention may encompass cutting inserts that are asymmetric and which are not indexable or reversible. It should also be understood that although the specific embodiments set forth herein comprise roof drill bits for use in the penetration of earth strata, the principles set forth with respect to these cutting inserts also have application to metalcutting inserts, as well.

The patents and other documents identified herein are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A rotatable cutting bit for penetrating an earth formation, the bit comprising:

an elongate bit body having a forward end and a rearward end, the bit body defining a peripheral surface, the bit body having a central longitudinal axis and a center of rotation;

the bit body containing a first seat and a second seat at the axially forward end thereof;

a first cutting insert being retained in the first seat so as to present a first clearance cutting edge which radially extends past the peripheral surface of the bit body so as to engage the earth formation, and the first cutting insert having a first leading cutting edge that engages the earth formation, and substantially all of the first leading cutting edge being disposed at a first lead angle (C) between 50 degrees and 90 degrees wherein the first lead angle (C) is the included angle between a pair of intersecting lines (E—E and F—F) wherein one line (E—E) is along the first leading cutting edge and another line (F—F) is parallel to the center of rotation of the bit body; and a second cutting insert being retained in the second seat so as to present a second clearance cutting edge which radially extends past the peripheral surface of the bit body so as to engage the earth formation, and the second cutting insert having a second leading cutting edge that engages the earth formation, substantially all of the second leading cutting edge being disposed at a second lead angle (C) between 50 degrees and 90 degrees wherein the second lead angle (C) is the included angle between a pair of intersecting lines (E—E and F—F) wherein one line (E—E) is along the second leading cutting edge and another line (F—F) is parallel to the center of rotation of the bit body.

2. The rotatable cutting bit of claim 1 wherein the first cutting insert is disposed so as to have a first radial rake angle (D) between about positive 20 degrees and about negative 30 degrees wherein the first radial rake angle (D) is the included angle between a pair of intersecting lines (L—L and M—M) wherein one line (L—L) is a radial line from the central longitudinal axis of the bit body through the center point (J) of the first leading cutting edge and the other line (M—M) is along the first leading cutting edge of the first cutting insert so that the first radial rake angle (D) is negative when the line (M—M) along the first leading cutting edge trails the radial line (L—L) at a location outside the periphery of the cutting insert with respect to the direction of rotation of the cutting bit, and the first radial rake angle (D) is positive when the line (M—M) along the first leading cutting edge leads the radial line (L—L) at a location outside the periphery of the cutting insert with respect to the direction of rotation of the cutting bit.

3. The rotatable cutting bit of claim 2 wherein the first cutting insert includes an edge opposite to the first leading cutting edge; and the first cutting insert being disposed so as to have a first insert rake angle between about 0 degrees and about −30 degrees wherein the first insert rake angle (B) is defined as the included angle between a line (I—I) normal to both the lead angle reference line (E—E) and the central longitudinal axis (A—A) of the bit body and a line (H—H) lying along the top surface of the cutting insert and passing through the center (J) of the leading cutting edge and the center (K) of the edge wherein the first insert rake angle (B) is measured in the vicinity of the center (K) of the edge; when the cutting insert has an orientation such that line (H—H) is leading line (I—I) upon forward penetration of the cutting bit in the direction of axial penetration (Y) during drilling the insert rake angle (B) is positive; and when the cutting insert has an orientation such that line (H—H) is trailing line I—I upon forward penetration of the cutting bit in the direction of axial penetration (Y) during drilling the insert rake angle (B) would be negative.

4. The rotatable cutting bit of claim 3 wherein the first lead angle (C) is about 70 degrees, the first insert rake angle (B) is about negative 20 degrees, and the first radial rake angle (D) is about negative 10 degrees.

5. The rotatable cutting bit of claim 1 wherein at least a portion of the first clearance cutting edge being disposed at an included angle (N or Q or R or S) with respect to the first leading cutting edge of between about 90 degrees and about 130 degrees.

6. The rotatable cutting bit of claim 1 wherein at least a portion of the first clearance cutting edge of the first cutting insert being generally parallel to the axis of rotation of the bit body.

7. The rotatable cutting bit of claim 1 wherein the bit body containing a cavity, the bit body containing an unobstructed passage at the forward end thereof, and wherein the passage providing communication between the cavity and the forward end of the bit body.

8. The rotatable cutting bit of claim 1 wherein the cutting insert is indexable.

9. The rotatable cutting bit of claim 1 wherein the cutting insert is indexable.

10. The rotatable cutting bit of claim 1 wherein the first leading cutting edge has a radically inward end and a radically outward end, and the radically inward end of the first leading cutting edge being the axially forwardmost portion of the first leading cutting edge; and the second leading cutting edge has a radically inward end and a radically outward end, and the radically inward end of the second leading cutting edge being the axially forwardmost portion of the second leading cutting edge.

11. A rotatable cutting bit for penetrating an earth formation, the bit comprising:

an elongate bit body having a forward end and a rearward end, the bit body defining a peripheral surface, the bit body having a central longitudinal axis and a center of rotation;

the bit body containing a first seat and a second seat at the axially forward end thereof;

a first cutting insert being retained in the first seat so as to present a first clearance cutting edge which radially extends past the peripheral surface of the bit body so as to engage the earth formation, and the first cutting insert having a first leading cutting edge that engages the earth formation, and the first leading cutting edge being disposed at a first lead angle (C) between 50 degrees and 90 degrees wherein the first lead angle (C) is the included angle between a pair of intersecting lines (E—E and F—F) wherein one line (E—E) is along the first leading cutting edge and another line (F—F) is parallel to the center of rotation of the bit body; and a second cutting insert being retained in the second seat so as to present a second clearance cutting edge which radially extends past the peripheral surface of the bit body so as to engage the earth formation, and the second cutting insert having a second leading cutting edge that engages the earth formation, the second leading cutting edge being disposed at a second lead angle (C) between 50 degrees and 90 degrees wherein the second lead angle (C) is the included angle between a pair of intersecting lines (E—E and F—F) wherein one line (E—E) is along the second leading cutting edge and another line (F—F) is parallel to the center of rotation of the bit body;

at least a portion of the first clearance cutting edge of the first cutting insert being disposed at an included angle (N or Q or R or S) of about 110 degrees with respect to the first leading cutting edge.

12. The rotatable cutting bit for penetrating an earth formation, the bit comprising:

an elongate bit body having a forward end and a rearward end, the bit body defining a peripheral surface, the bit body having a central longitudinal axis and a center of rotation;

the bit body containing a first seat and a second seat at the axially forward end thereof;

a first cutting insert being retained in the first seat so as to present a first clearance cutting edge which radially extends past the peripheral surface of the bit body so as to engage the earth formation, and the first cutting insert having a first leading cutting edge that engages the earth formation, and the first leading cutting edge being disposed at a first lead angle (C) between 50 degrees and 90 degrees wherein the first lead angle (C) is the included angle between a pair of intersecting lines (E—E and F—F) wherein one line (E—E) is along the first leading cutting edge and another line (F—F) is parallel to the center of rotation of the bit body; and a second cutting insert being retained in the second seat so as to present a second clearance cutting edge which radially extends past the peripheral surface of the bit body so as to engage the earth formation, and the second cutting insert having a second leading cutting edge that engages the earth formation, the second leading cutting edge being disposed at a second lead angle (C) between 50 degrees and 90 degrees wherein the second lead angle (C) is the included angle between a pair of intersecting lines (E—E and F—F) wherein one line (E—E) is alone the second leading cutting edge and another line (F—F) is parallel to the center of rotation of the bit body;

wherein the first cutting insert is of a generally triangular shape, and the second cutting insert is of a generally triangular shape.

13. A rotatable cutting bit for penetrating an earth formation, the bit comprising:

an elongate bit body having a forward end and a rearward end, the bit body defining a peripheral surface, the bit body having a central longitudinal axis and a center of rotation;

the bit body containing a first seat and a second seat at the axially forward end thereof;

a first cutting insert being retained in the first seat so as to present a first clearance cutting edge which radially extends past the peripheral surface of the bit body so as to engage the earth formation; and the first cutting insert having a first leading cutting edge that engages the earth formation, and the first leading cutting edge being disposed at a first lead angle (C) between 50 degrees and 90 degrees wherein the first lead angle (C) is the included angle between a pair of intersecting lines (E—E and F—F) wherein one line (E—E) is along the first leading cutting edge and another line (F—F) is parallel to the center of rotation of the bit body; and a second cutting insert being retained in the second seat so as to resent a second clearance cutting edge which radially extends past the peripheral surface of the bit body so as to engage the earth formation, and the second cutting insert having a second leading cutting edge that engages the earth formation, the second leading cutting edge being disposed at a second lead angle (C) between 50 degrees and 90 degrees wherein the second lead angle (C) is the included angle between a pair of intersecting lines (E—E and F—F) wherein one line (E—E) is along the second leading cutting edge and another line (F—F) is parallel to the center of rotation of the bit body;

wherein the first cutting insert includes a top surface, one side surface, and another side surface, the one side surface intersecting the top surface to form the first leading cutting edge, the one side surface intersecting the other side surface to from an edge, and a relieved surface at the edge wherein the intersection of the relieved surface and the side surface define a first clearance cutting edge.

14. The rotatable cutting bit of claim 13 wherein the relieved surface is generally arcuate.

15. The rotatable cutting bit of claim 13 wherein the relieved surface is generally planar.

16. The rotatable cutting bit of claim 13 wherein one portion of the relieved surface is generally arcuate and another portion of the relieved surface is generally planar.

17. A rotatable cutting bit for penetrating an earth formation, the bit comprising:

an elongate bit body having a forward end and a rearward end, the bit body defining a peripheral surface, the bit body having a central longitudinal axis and a center of rotation;

the bit body containing a first seat and a second seat at the axially forward end thereof;

a first cutting insert being retained in the first seat so as to present a first clearance cutting edge which radially extends past the peripheral surface of the bit body so as to engage the earth formation, and the first cutting insert having a first leading cutting edge that engages the earth formation, and the first leading cutting edge being disposed at a first lead angle (C) between 50 degrees and 90 degrees wherein the first lead angle (C) is the included angle between a pair of intersecting lines (E—E and F—F) wherein one line (E—E) is along the first leading cutting edge and another line (F—F) is parallel to the center of rotation of the bit body; and a second cutting insert being retained in the second seat so as to present a second clearance cutting edge which radially extends past the peripheral surface of the bit body so as to engage the earth formation, and the second cutting insert having a second leading cutting edge that engages the earth formation, the second leading cutting edge being disposed at a second lead angle (C) between 50 degrees and 90 degrees wherein the second lead angle (C) is the included angle between a pair of intersecting lines (E—E and F—F) wherein one line (E—E) is along the second leading cutting edge and another line (F—F) is parallel to the center of rotation of the bit body;

wherein the first cutting insert comprising a top surface, a bottom surface, a first side surface, a second side surface, and a third side surface; the first, second and third side surfaces joining the top and bottom surfaces; the first side surface intersecting the second side surface to form a first edge, the second side surface intersecting the third side surface to form a second edge, and the third side surface intersecting the first side surface to form a third edge; and the first side surface adjacent the first edge being disposed at an included angle (Q) with respect to the top surface of about 90 degrees, and the first side surface adjacent the third edge being disposed at an included angle (Q) with respect to the top surface of about 110 degrees.

18. The rotatable cutting bit of claim 17 wherein the second side surface adjacent the first edge being disposed at an included angle (Q) with respect to the top surface of about 90 degrees, and the second side surface adjacent the second edge being disposed at an included angle (Q) with respect to the top surface of about 110 degrees; and the third side surface adjacent the second edge being disposed at an included angle (Q) with respect to the top surface of about 110 degrees, and the third side surface adjacent the third edge being disposed at an included angle (Q) with respect to the top surface of about 90 degrees.

19. The rotatable cutting bit of claim 17 wherein a first relieved surface being at the first edge adjacent to the top surface of the cutting insert; and a second relieved surface being at the second edge adjacent to the bottom surface of the cutting insert.

20. The rotatable cutting bit of claim 19 wherein the first relieved surface presenting a generally planar surface disposed at an included angle (R) with respect to the top surface of between about 90 degrees and about 130 degrees; and the second relieved surface presenting a generally planar surface disposed at an included angle (S) with respect to the bottom surface of between about 90 degrees and about 130 degrees.

21. An elongate rotatable cutting bit body for carrying at least one cutting insert, and the bit body having a central longitudinal axis, the bit body comprising:

a forward end, a rearward end, and a seat at toe forward end, the seat receives the cutting insert; and the seat being defined by a bottom surface, a radial edge that extends generally radially from the central longitudinal axis of the bit body, a radial side surface which extends generally radially from the central longitudinal axis of the bit body and becomes greater as it moves radially outwardly, and a chordal side surface which extends between the radial edge and the radial side surface, and the chordal side surface becomes greater as it moves toward the radial side surface.

22. The cutting bit body of claim 21 wherein the deepest portion of the seat is adjacent to the juncture of the chordal side surface and the radial side surface.

23. The cutting bit body of claim 21 wherein the chordal side surface and the radial edge intersect radially inwardly of the peripheral surface of the cutting bit body.

24. The cutting bit body of claim 21 wherein the chordal side surface and the radial edge do not intersect so that the seat is open where the radial edge intersects the peripheral surface of the cutting bit body.

25. A cutting insert for use in a rotatable cutting bit for the penetration of an earth formation wherein the cutting insert is disposed in a seat in the cutting bit with a peripheral surface wherein the leading cutting edge which engages the earth formation is disposed at a lead angle (C) between 50 degrees and 90 degrees, the cutting insert comprising:

a cutting insert body having a top surface, a bottom surface, a first side surface, and a second side surface, the first side surface intersects the second side surface to form a first edge; the first and second side surfaces joining the top surface and the bottom surface; the first edge defining at least in part a clearance cutting edge which extends radially past the peripheral surface of the cutting bit when the cutting insert is in the seat so as to engage the earth formation.

26. The cutting insert of claim 25 wherein the first edge has a portion thereof being generally arcuate.

27. The cutting insert of claim 25 wherein the first edge has a portion thereof being generally planar.

28. The cutting insert of claim 25 wherein the cutting insert body further includes a third side surface which joins the top and bottom surfaces; the second side surface intersecting the third side surface to form a second edge, and the third side surface intersecting the first side surface to form a third edge; and the first side surface adjacent the first edge being disposed at an included angle (Q) with respect to the top surface of about 90 degrees, and the first side surface adjacent the third edge being disposed at an included angle (Q) with respect to the top surface of about 110 degrees.

29. The cutting insert of claim 28 wherein the second side surface adjacent the first edge being disposed at an included angle (Q) with respect to the top surface of about 90 degrees, and the second side surface adjacent the second edge being disposed at an included angle (Q) with respect to the top surface of about 110 degrees; and the third side surface adjacent the second edge being disposed at an included angle (Q) with respect to the top surface of about 110 degrees, and the third side surface adjacent the third edge being disposed at an included angle (Q) with respect to the top surface of about 90 degrees.

30. The cutting insert of claim 25 wherein the cutting insert is indexable.

31. The cutting insert of claim 25 wherein the cutting insert is reversible.

32. The cutting insert of claim 25 the cutting insert body further including a third side surface joining the top and bottom surfaces; the second side surface intersecting the third side surface to form a second edge; a first relieved surface being at the first edge adjacent to the top surface of the cutting insert; and a second relieved surface being at the second edge adjacent to the bottom surface of the cutting insert.

33. The cutting insert of claim 32 wherein the first relieved surface presenting a generally planar surface disposed at an included angle (R) with respect to the top surface of between about 90 degrees and about 130 degrees; and the second relieved surface presenting a generally planar surface disposed at an included angle (S) with respect to the bottom surface of between about 90 degrees and about 130 degrees.

34. A replaceable cutting insert for use in a rotatable cutting bit for engaging the earth strata, the cutting bit having a cutting bit body containing a seat which receives the cutting insert, the cutting insert comprising:

a cutting insert body having two surfaces which intersect to form a cutting edge, and during operation of the rotatable cutting bit the cutting edge engaging the earth strata, the cutting insert body being of a generally triangular shape; and the cutting insert body being made from one of the following materials: ceramics, binderless tungsten carbide, polycrystalline diamond composites with metallic binder, polycrystalline diamond composites with ceramic binder, tungsten carbide-cobalt alloys having a hardness greater than or equal to about 90.5 Rockwell A, and hard coated cemented carbides.

35. The cutting insert of claim 34 wherein the ceramics include silicon nitride-based ceramics, and alumina-based ceramics.

36. The cutting insert of claim 34 wherein the tungsten carbide-cobalt alloys comprise between about 5.7 and about 6.0 weight percent cobalt with the balance being tungsten carbide, and the alloys having a coercive force ($H_C$) between about 265 and about 350 oersteds and a hardness between about 92.7 and about 93.3 Rockwell A.

37. The cutting insert of claim 34 wherein the tungsten carbide-cobalt alloys have a hardness greater than or equal to 91.0 Rockwell A.

38. The cutting insert of claim 34 wherein the tungsten carbide-cobalt alloys have a coercive force ($H_C$) greater than or equal to 160 oersteds.

39. The cutting insert of claim 34 wherein the tungsten carbide-cobalt alloys have a coercive force ($H_C$) greater than or equal to 180 oersteds.

40. The cutting insert of claim 34 wherein substantially all of the cutting edge is at a consistent orientation with respect to the cutting bit body when the cutting insert is attached to the cutting bit body.

* * * * *